United States Patent [19]

Weigl et al.

[11] 4,230,338

[45] Oct. 28, 1980

[54] SAFETY SKI BINDING

[75] Inventors: Erwin Weigl, Brunn; Karl Stritzl, Vienna, both of Austria

[73] Assignee: Polyair Produkt Design Gesellschaft m.b.H., Kittsee, Austria

[21] Appl. No.: 965,040

[22] Filed: Nov. 30, 1978

[30] Foreign Application Priority Data

Dec. 6, 1977 [AT] Austria ..... 8739/77

[51] Int. Cl.[3] ..... A63C 9/081

[52] U.S. Cl. ..... 280/618; 280/628

[58] Field of Search ..... 280/614, 616, 617, 618, 280/620, 628

[56] References Cited

U.S. PATENT DOCUMENTS

| | | | |
|---|---|---|---|
| 3,930,660 | 1/1976 | Fréchin | 280/618 |
| 4,081,186 | 3/1978 | Beyl | 280/618 |

FOREIGN PATENT DOCUMENTS

| | | | |
|---|---|---|---|
| 2339738 | 3/1974 | Fed. Rep. of Germany | 280/618 |

*Primary Examiner*—Robert J. Spar
*Assistant Examiner*—Fred A. Silverberg
*Attorney, Agent, or Firm*—Scully, Scott, Murphy & Presser

[57] ABSTRACT

This invention relates to a safety binding comprising a soleplate. The usual bindings may release the boot in response to a deflection of the ski caused by large waves. It is an object of the present invention to provide a binding which has a soleplate and which can store a larger energy and will not undesirably release the boot in response to a resilient deflection of the ski. Besides, the binding according to the invention provides for favorable kinematics as regards the movements which result in the release of a boot by a safety binding. For this purpose the invention provides a spring-biased heel holder and a soleplate, which is mounted to be displaceable in the longitudinal direction of the soleplate and is connected to the heel holder by a universal joint and which near that end which is remote from the heel holder is pivoted on an axis which is transverse to the soleplate.

14 Claims, 6 Drawing Figures

SAFETY SKI BINDING

Figure 1:
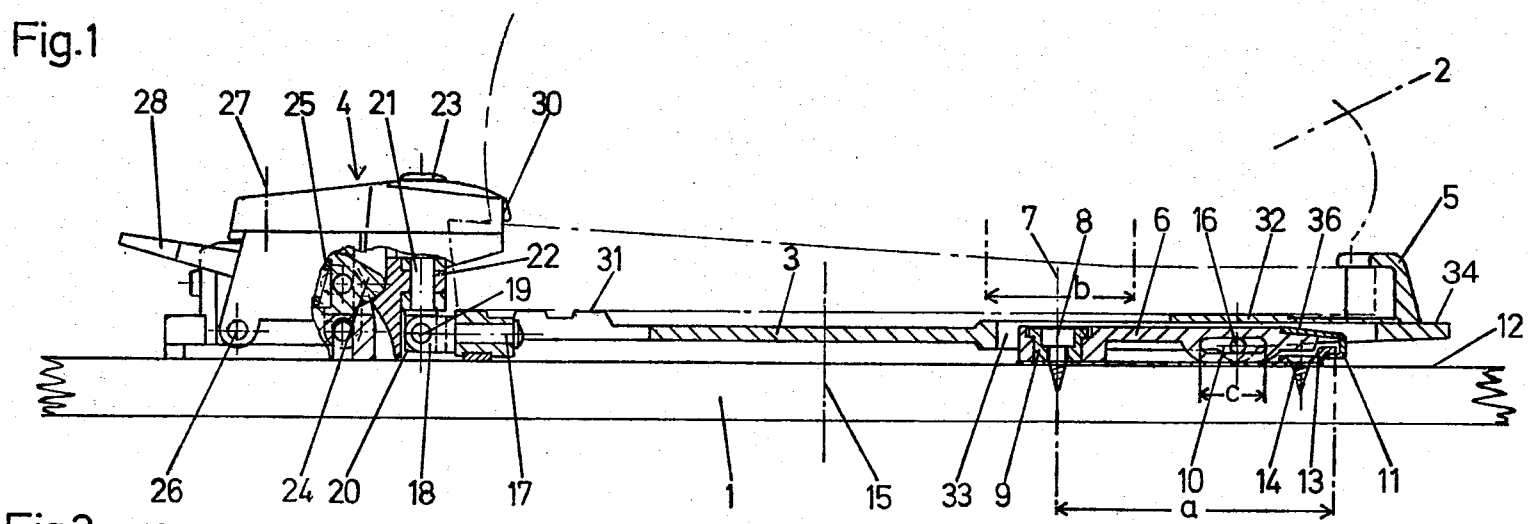

This invention relates to a safety ski binding comprising a soleplate, a toe holder, which is disposed at one end of the soleplate and cooperates with the toe portion of the boot, and a releasing device, which cooperates with the rear end of the soleplate and permits of a release of the skiing boot, wherein the soleplate is pivoted to an adapter on an axis which is substantially transverse to the longitudinal direction of the soleplate and said adapter is adapted to be pivoted to the ski for a movement together with the soleplate about an axis which is at right angles to the plane of the soleplate.

The known safety bindings if that kind comprise a number of different components, by which the soleplate can be secured to the surface of a ski. In one embodiment of these known safety ski bindings, the soleplate of its anchoring means is released from the ski together with the skiing boot in case of a fall and the soleplate constituting a separate component may be lost in such case. All known embodiments are relatively complicated in structure so that they are highly liable to be deranged.

It is also known to connect a soleplate to a ski by an adapter to which the forward end of the soleplate is connected by a rigidly mounted pivot. In that embodiment a deflection of the ski may cause the soleplate to separate from the rear overload coupling which serves to hold the soleplate, and the soleplate may perform an unintended pivotal movement about the forward end of the boot. That known safety binding provided with a soleplate has also various kinematic disadvantages and for this reason cannot be relied upon to release the foot when this is required.

It is an object of the present invention to improve the known safety bindings which are of the kind described first hereinbefore and comprise a soleplate and to increase the energy storage capacity of the binding and at the same time to avoid an undesired release of the binding in case of an elastic deflection of the ski. This object is accomplished according to the invention essentially in that the spring-biased releasing device is adapted to be pivotally moved in vertically upward and lateral directions, the soleplate is mounted on a pivot which is transverse to the longitudinal direction of the soleplate and displaceable in said longitudinal direction, and the rear end of the soleplate is connected to the releasing device by an articulated joint, which is inseparable under operating conditions. In such a safety ski binding the means which enable the two pivotal movements about axes which are substantially vertical and substantially horizontal, respectively, and the means for compensating the deflection of the ski are provided on a single adapter so that the structure is greatly simplified. Because that adapter is adapted to be secured to the ski in front of the length center of the soleplate, the kinematics of the movement of a foot are optimally provided for. A boot is usually rotated approximately in the ball region. As the adapter is disposed in front of the length center of the soleplate, the axis of rotation which is approximately at right angles to the surface of the ski can be arranged in that kinematically favorable region. The upward pivotal movement of the heel is also effected about an axis which is near the toe portion of the boot. The mounting of the adapter in front of the length center of the soleplate is suitable for such movement because the horizontal pivotal axis for the soleplate is disposed in the forward end region of the soleplate. Since the soleplate is mounted on the adapter to be longitudinally displaceable in the longitudinal direction of the ski, said adapter serves also to compensate the deflection of the ski so that a single component is sufficient for mounting the soleplate. This requires that the rear end of the soleplate is also held by suitable means, and it is essential in accordance with the invention that the rear end of the soleplate is connected to the spring-biased releasing device by an articulated joint. In this way, the rear end of the soleplate is retained and its forward end can be pivoted to a single component. This design of the safety binding permits the rear end of the soleplate to be connected to the releasing device by an articulated joint which is so designed that the soleplate is inseparably connected to the adapter and the releasing device under operating conditions so that the soleplate cannot be lost when the safety binding has released the boot.

Because the pivots for the vertical release are arranged near the heel-releasing device and the pivot for the horizontal release of the safety binding is arranged near the toe portion of the boot or the ball region, the safety ski binding according to the invention can store as much energy as conventional ski bindings having no soleplate whereas the dimensions of the binding need not be greatly increased. The assembling is greatly simplified because the horizontal and vertical pivots and the means for compensating the deflection of the ski are combined in a single component.

In a preferred embodiment of the invention, the pivot which is normal to the surface of the ski and provided on the adapter is spaced, in a top plan view, from the toe holder provided on the soleplate by a distance which is approximately as large as the distance from said toe holder to the ball of a foot of a wearer of the skiing boot. That design results in a particularly suitable release characteristic.

The soleplate is preferably connected by the transverse horizontal pivot to the adapter so as to be displaceable in the longitudinal direction of the ski. As a result, the transverse horizontal axis and the articulated joint at the rear end of the soleplate are both utilized to prevent a vertical displacement of the soleplate and a particularly simple design is obtained. The adapter may preferably consist of a link and be adapted to be pivoted at one end to the ski on an axis which is at right angles to the surface of the ski. That end of the link at which the latter is pivoted to the surface of the ski on a vertical axis is preferably remote from the tip of the ski, and the free end of the link is preferably guided approximately parallel to the surface of the ski by an arcuate guide, which is adapted to be secured to the ski. That arcuate guide may simply be constituted by an arcuate section member, which is rigidly secured to the surface of the ski and provides an arcuate guide having a radius that is equal to the distance from the vertical pivotal axis. In this way the link is reliably pivoted to the surface of the ski and the overlap of a retaining element which extends under said arcuate guide will be the same in all angular positions.

That portion of the soleplate which is disposed in front of its length center is preferably provided with an opening for receiving the adapter. In this way the overall height can be descreased. The design is preferably such that the link has a slot, which is transverse to the longitudinal axis of the link and in which the horizontal pivot of the soleplate is mounted. That slot is preferably provided at that end of the link which is nearer the tip of the ski so that the horizontal pivot is as close as possible to the forward end of the soleplate. This feature and the additional features residing in that the adapter has adjacent to the toe portion of the boot a surface which is inclined to the surface of the ski when the adapter is mounted thereon and the forward end portion of the soleplate extends over said inclined surface and that the soleplate tapers in longitudinal section toward its forward end and adjacent to its forward end has on its underside an inclined surface, result in a further decrease of the distance required between the surface of the ski and the soleplate and at the same time enable a pivotal movement of the soleplate about the horizontal pivotal axis in case of a vertical release of the releasing device.

In another preferred embodiment of the safety ski binding according to the invention the soleplate is provided at its rear end with a head, which carries a pivot which is parallel to the surface of the soleplate and transverse to the longitudinal axis thereof and cooperates with a member of the releasing device. In this way the rear end of the soleplate is pivoted to the releasing member on said transverse pivot. To permit of a lateral pivotal movement of the releasing member and of the soleplate in unison, that member of the releasing device which cooperates with the transverse pivot at the rear end of the soleplate must consist of a pin, the axis of which in the closed position of the binding is approximately normal to the surface of the ski, said pin is guided at one end in a bore of the releasing device for rotation on the axis of the pin and is held there against falling out of the bore, and at its other end is provided with a transverse bore or a head, and the transverse pivot at the rear end of the soleplate extends through said transverse bore or head. In that arrangement, a lateral pivotal movement of the releasing device will result in a rotation of the pin in the bore of the releasing device so that the transverse pivot mounted in the adapter is displaced toward the releasing member. The slot in the adapter must be so wide that the transverse pivot in the forward portion of the soleplate can perform this displacement. In a simple arrangement, the rear end portion of the soleplate has an opening which extends in the longitudinal direction of the soleplate and receives a pin, which is held against axial displacement and has an end portion that protrudes rearwardly from the soleplate and carries a head, which carries a transverse pivot.

Because the adapter compensates the deflection of the ski, the adapter will be guided with lateral play in an opening which is formed in the soleplate and adapted to receive the adapter so that the adapter will not obstruct the displacement of the soleplate in its axial direction and in the direction of the adapter. That lateral play also permits of slight angular movement by which the pivot that is transverse to the longitudinal direction of the soleplate is moved to a more or less oblique position. The impact of the adapter at the edge of the opening in the soleplate may result in an undesired release of the binding. For this reason, within the scope of the invention the adapter is preferably connected to the soleplate with elastically deformable cushioning means interposed. This provides for an absorption of shocks and for a more reliable release when the preset forces required for a release are exceeded.

In a simple arrangement, the width of the adapter, measured transversely to its longitudinal direction is less than the width of the opening of the soleplate, and the cushioning means consist of lateral extensions of the adapter. These lateral extensions may extend substantially parallel to the longitudinal direction of the adapter and the spring rate may be adjustable in that a clamping element is provided between the body of the adapter and its resilient extensions and is displaceable in the longitudinal direction of the adapter and adapted to be fixed in its adjusted position. This permits of an adjustment of the cushioning means to different spring rates.

The invention will now be explained more fully with reference to the drawings, in which an embodiment is shown diagrammatically and by way of example and with additional details which are essential for the invention.

Figure 2:
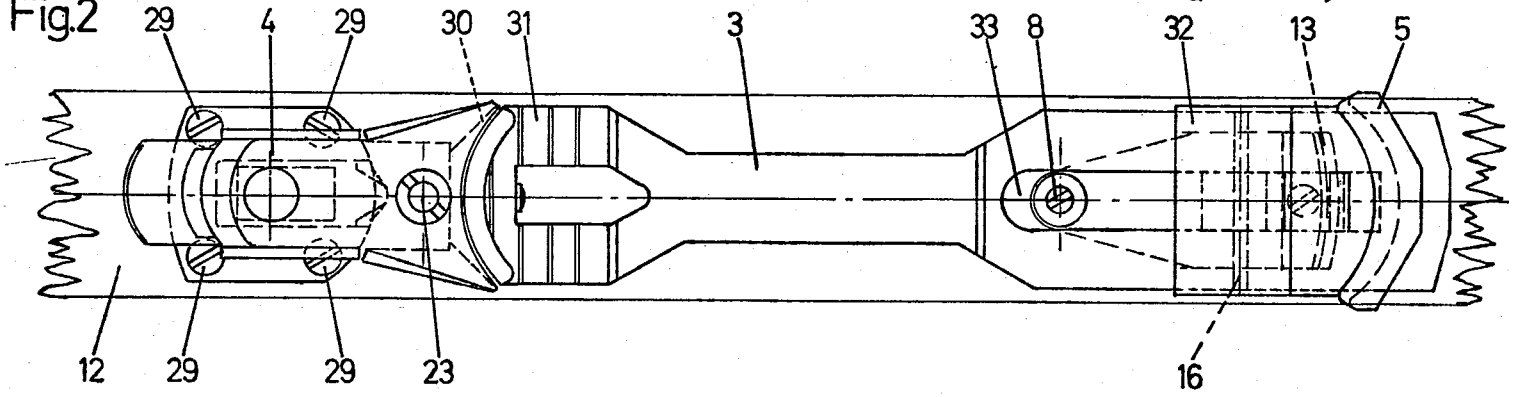
Figure 3:
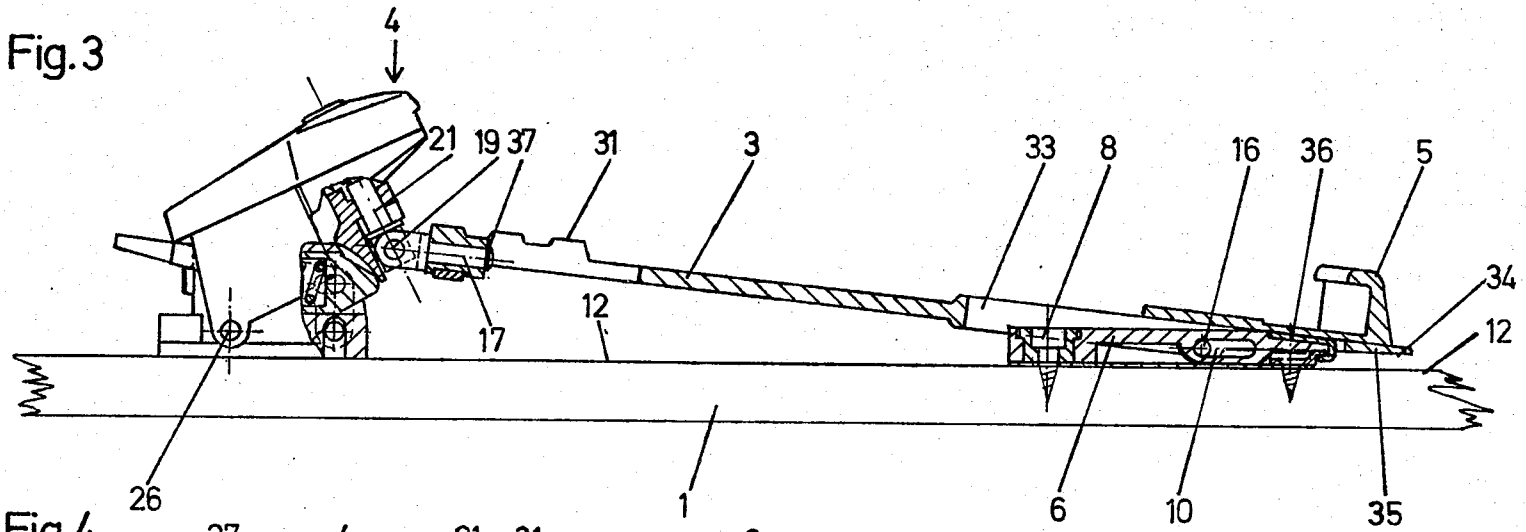
Figure 4:
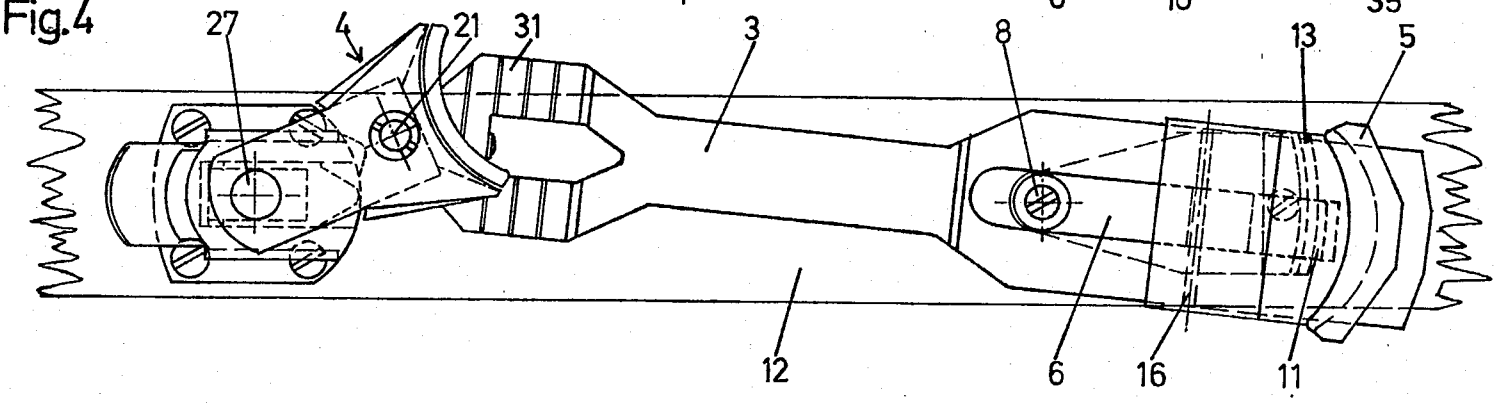
Figure 5:
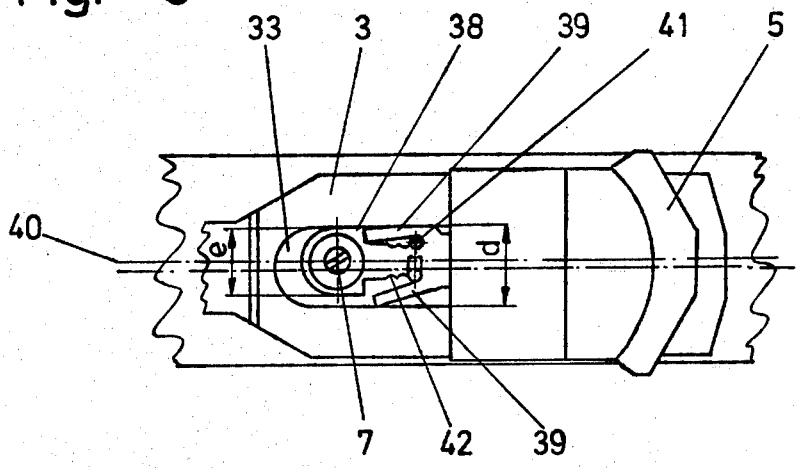
Figure 6:
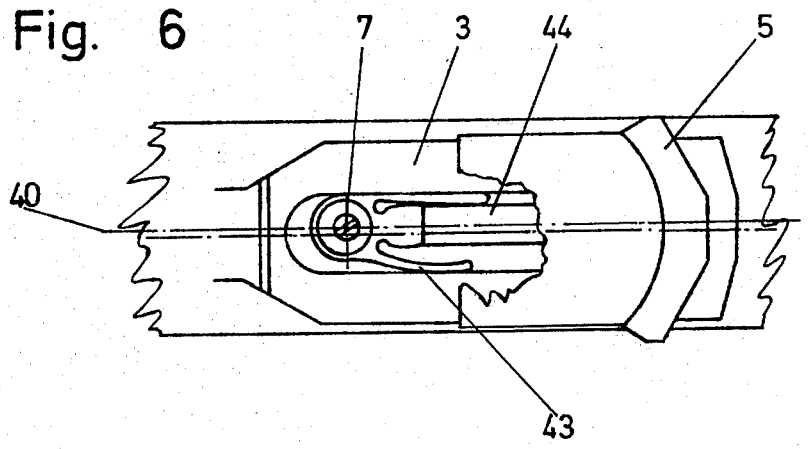

FIG. 1 is a longitudinal sectional view showing a safety ski binding which embodies the invention and is mounted on a ski, FIG. 2 is a top plan view showing the safety binding of FIG. 1, FIG. 3 is a longitudinal sectional view showing the safety ski binding of FIG. 1, with the releasing device open, FIG. 4 is a top plan view showing the safety ski binding of FIG. 1 after the releasing device has been pivotally moved laterally, FIG. 5 is a top plan view showing a detail of the pivotal mounting of the soleplate near the toe holder and FIG. 6 is a top plan view showing a further modification of said detail.

FIG. 1 shows a skiing boot 2, which is to be secured to a ski 1. The safety ski binding comprises a soleplate 3, a heel-releasing device 4, and a toe holder 5, which is secured to the soleplate 3. A link 6 is pivoted to the ski 1 on a vertical pivot 7, which is defined by a screw 8, which by means of a slider 9 holds the link 6 against a vertical movement relative to the ski 1. At its forward end, the link has a slot 10 and a downwardly protruding, resilient clamp 11, which extends under an arcuate guide 13, which is secured by screws 14 to the surface 12 of the ski 1. As is apparent from FIG. 2, the radius of curvature of the arcuate guide 13 equals the distance a from the axis of the vertical pivot 7 to the forward end of the guide 13. Before its length center 15, the soleplate 3 has near its forward end a horizontal pivot 16, which is parallel to the surface of the ski and guided in the slot 10 of the link 6. The vertical pivot 7 is disposed in the ball region b of the foot of the wearer of the skiing boot. The horizontal pivot 16 is disposed below the toe portion of the foot. During a deflection of the ski, the horizontal pivot's movement relative to the soleplate 3 is taken up in the transverse horizontal axis in the slot 10.

The soleplate 3 is provided at its rear end with a pin 17, which carries a head 18. The latter has apertures for receiving a pivot 19, which extends through a transverse bore of the head 20 of a pin 21, which is mounted in the releasing device and is rotatably mounted in its bore 22 and held against axial displacement by an expanding ring 23. The releasing device 4 is of conventional design. A spring-biased locking or releasing member 24 can be pivotally raised about a horizontal pivot 26 against the force of the spring 25 and can be pivotally moved laterally about a substantially vertical pivot 27. An actuating lever 28 serves for an arbitrary release of the releasing device. As is apparent from FIG. 2, the releasing device 4 is rigidly secured to the surface 12 of the ski 1 by screws 29. In FIGS. 2 to 4, like elements have been designated with the same reference characters.

The releasing device 4 comprises jaws 30 for cooperating with the heel portion of the boot.

As is apparent from FIG. 2, the soleplate 3 consists of a pedal. The rear portion 31 of the soleplate 3 is profiled and is wider than the slender intermediate portion of the soleplate 3. The forward portion 2 of the soleplate is wider than the intermediate portion and just as the rear portion 31 is higher in side elevation so that the heel and toe portions of the boot will reliably bear on the soleplate regardless of the degree to which the sole has been worn. The soleplate 3 has an opening 33 for receiving the line 6. In the condition for use shown in FIGS. 1 and 2, the link has been received in the opening 33 so that the overall height is decreased.

FIG. 3 shows the releasing device after a pivotal movement about the pivot 26 so that the rear end 31 of the soleplate 3 has been lifted from the surface 12 of the ski by means of the pivot 19 and the pins 17 and 21. During a release of the binding to the position shown in FIG. 3, the link 6 remains in the position shown in FIGS. 1 and 2 and only the transverse pivot 16 in the forward portion of the soleplate moves in the slot 10 toward the releasing device 4. During the pivotal movement of the soleplate 3, its end portion 34 which carries the toe holder comes nearer to the surface 12 of the ski 1. For this reason that end portion has on its underside a bevelled surface 35 and the link 6 is provided with a bevelled surface 36 at its forward end so that a relatively large pivotal movement about the pivot 16 is enabled in conjunction with a smaller overall height and there is no risk of a collision of the forward end 34 of the soleplate 3 with the surface 12 of the ski 1.

To effect a lateral release of the safety ski binding as to the position shown in FIG. 4, the releasing device 4 is pivotally moved about the vertical pivot 27 and the pin 21 is rotated in its bore 22 from its normal position. As a result, the rear end 31 of the soleplate 3 remains hinged to the releasing device. The link 6 is pivotally moved about the vertical axis 7 of the screw 8 and the clamp 11 at the forward end of the link is moved along the arcuate guide 13. When the releasing device 4 is pivotally moved about the horizontal pivot 16 at the same time, the link 6 will emerge downwardly from the opening 33 of the soleplate because in that case too the link 6 is held to and guided along the surface 12 of the ski by the screw 8 and the arcuate guide 13. In any case the slot 10 has such a length c that even when the releasing device 4 has been pivotally moved to release the skiing boot the transverse pivot 16 in the forward portion of the soleplate can be accommodated in the slot 10 without obstructing the pivotal movement of the releasing device 4.

It is apparent from FIGS. 1 and 3 that the pin 17 is received in an opening at the rear end of the soleplate 3 and is held against an axial displacement by being riveted or by an expanding ring 37.

It is apparent from FIG. 4 that the overlap between the resilient clamp 11 and the arcuate guide 13 is the same in all angular positions of the link 6 so that the latter is reliably guided on the surface 12 of the ski. This design ensures a constant overlap between the resilient clamp 11 and the arcuate guide 13 even when the ski is being deflected.

FIG. 5 shows a soleplate 3, which is pivoted to the adapter by a vertical pivot 7, which is substantially at right angles to the soleplate. The adapter 38 has extensions 39, which protrude laterally from its longitudinal axis. In the position shown in FIG. 5, the soleplate 3 has been slightly laterally displaced from the longitudinal axis 40 so that the extensions 39 have been deformed. In the relaxed condition, the adapter 38 is centered in the opening 33 of the soleplate 3 and the extensions 39 protruding from the adapter 38 are symmetrical to the longitudinal axis 40 and engage the edge of the opening 33. The width d of the opening 33 exceeds the width e of the adapter 38 so that the soleplate is capable of a slight pivotal movement, which causes the transverse horizontal axis 16 shown in FIG. 1 to assume an oblique position in the slot 10 of the adapter. The spring rate of the resilient extensions 39 can be adjusted by a ring 41 and will be particularly low when the ring is in the position shown in FIG. 5. A higher spring rate can be adjusted in that the ring 41 is shifted to the left in FIG. 5 and is resiliently locked in a notch, such as 42, of the adapter 38.

FIG. 6 shows a similar design, in which the spring rate of the resilient extensions 43 is not adjustable. The springs 43 of the adapter 44 are also shown in a position in which they are deformed. In position of rest, the laterally protruding extensions 43 are symmetrical to the longitudinal axis 40 of the soleplate and to the longitudinal axis 44 of the adapter.

We claim:

1. A safety ski binding comprising a soleplate, a toe holder, which is disposed at a forward end of the soleplate and cooperates with the toe portion of the boot, and a releasing device, which cooperates with the rear end of the soleplate and permits a release of the skiing boot, wherein the soleplate is pivoted to an adapter on an axis which is substantially transverse to the longitudinal direction of the soleplate and said adapter is adapted to be pivoted to the ski for a movement together with the soleplate about an axis which is at right angles to the plane of the soleplate, characterized in that a spring-biased releasing device (4) is adapted to be pivotally moved in vertically upward and lateral directions, the soleplate is mounted on a pivot (16) which is transverse to the longitudinal direction of the soleplate (3) and displaceable in said longitudinal direction, and the rear end of the soleplate (3) is connected to the releasing device (4) by an articulated joint, which is inseparable under operating conditions.

2. A safety ski binding according to claim 1, characterized in that a vertical pivot (7) which is normal to the surface of the ski and provided on the adapter (6) is spaced, in a top plan view, from the toe holder (5) provided on the soleplate (3) by a distance which is approximately as large as the distance from the toe holder (5) to the ball of a foot of a wearer of the ski boot.

3. A safety ski binding according to claim 1 or 2, characterized in that a free end of the adapter (6) remote from the pivot (7) connecting the adapter to the ski is guided approximately parallel to the surface of the ski (12) by an arcuate guide (13), which is adapted to be secured to the ski.

4. A safety ski binding according to claim 1, characterized in that that portion of the soleplate (3) which is disposed in front of its length center (15) is provided with an opening (33) for receiving the adapter (6).

5. A safety ski binding according to claim 1, characterized in that the adapter (6) has a slot (10), which is transverse to the longitudinal axis of the adapter and in which the horizontal pivot (16) of the soleplate (3) is mounted.

6. A safety ski binding according to claim 1, characterized in that the adapter (6) in its portion adjacent to the toe portion of the boot has a surface which is inclined to the surface of the ski when the adapter is mounted thereon and the forward end portion of the soleplate extends over said inclined surface.

7. A safety ski binding according to claim 1, characterized in that the soleplate (3) tapers in longitudinal section toward the forward end (34) and adjacent to the forward end (3) has on its underside an inclined surface.

8. A safety ski binding according to claim 1, characterized in that the soleplate (3) is provided at its rear end with a head (18), which carries a pivot (19) that is parallel to the surface of the soleplate (3) and transverse to the longitudinal axis thereof and cooperates with a member of the releasing device (4).

9. A safety ski binding according to claim 1, characterized in that the rear end portion of the soleplate (3) has an opening which extends in the longitudinal direction of the soleplate and receives a pin (17), which is held against axial displacement and has an end portion which protrudes rearwardly from the soleplate and carries a head (18), which carries a transverse pivot (19).

10. A safety ski binding according to claim 1, characterized in that a member of the releasing device (4) which cooperates with a transverse pivot (19) provided at the rear end of the soleplate (3) comprises a pin (21), which has an axis which in the closed position of the binding (FIGS. 1, 2) is approximately normal to the surface of the ski, said pin is guided at one end in a bore (22) of the releasing device (4) for rotation on the axis of the pin and is held there against falling out of the bore (22) and at its other end is provided with a transverse bore or a head (20) and the transverse pivot (19) at the rear end of the soleplate (3) extends through said transverse bore or head.

11. A safety ski binding according to claim 9 or 10, characterized in that the pin (17) is mounted for rotation on its axis in the opening at the rear end of the soleplate (3).

12. A device according to claim 1, characterized in that the adapter (6,38,44) is connected to the soleplate with elastically deformable cushioning means interposed.

13. A device according to claim 1, characterized in that the width (e) of the adapter (38,44), measured transversely to its longitudinal direction, is less than the width (d) of the opening (33) of the soleplate (3) and the width of a cushioning means comprises lateral extensons (39,43) of the adapter (38,44).

14. A device according to claim 13, characterized in that resilient laterial extensions (39,44) extend in position of rest substantially parallel to the longitudinal direction of the adapter (38,44) and a clamping element (41) is provided between the body of the adapter (38) and the resilient extensions (39) and is displaceable in the longitudinal direction of the adapter (38) and adapted to be fixed in its adjusted position.

* * * * *